United States Patent [19]

Christian

[11] 4,077,096

[45] Mar. 7, 1978

[54] CASKET HANDLE STRUCTURE

[76] Inventor: Francis R. Christian, 411 Ashland Ave., River Forest, Ill. 60305

[21] Appl. No.: 747,959

[22] Filed: Dec. 6, 1976

[51] Int. Cl.[2] ..... A61G 17/04

[52] U.S. Cl. ..... 27/2; 16/112

[58] Field of Search ..... 27/2-7, 27/35; 16/110 R, 112

[56] References Cited

U.S. PATENT DOCUMENTS

| | | | |
|---|---|---|---|
| 804,875 | 11/1905 | Nierstheimer | 27/5 |
| 1,779,488 | 10/1930 | Patterson | 27/2 |
| 3,698,037 | 10/1972 | Johnson | 16/112 |
| 3,823,447 | 7/1974 | Johnson | 27/2 |

*Primary Examiner*—John D. Yasko

*Attorney, Agent, or Firm*—Kinzer, Plyer, Dorn & McEachran

[57] ABSTRACT

This is concerned with a casket structure and more specifically relates to a handle mounting arrangement which will be structurally strong and will be constructed to take the loads involved but at the same time will present a pleasing exterior appearance which is important for caskets.

5 Claims, 4 Drawing Figures fig.1.
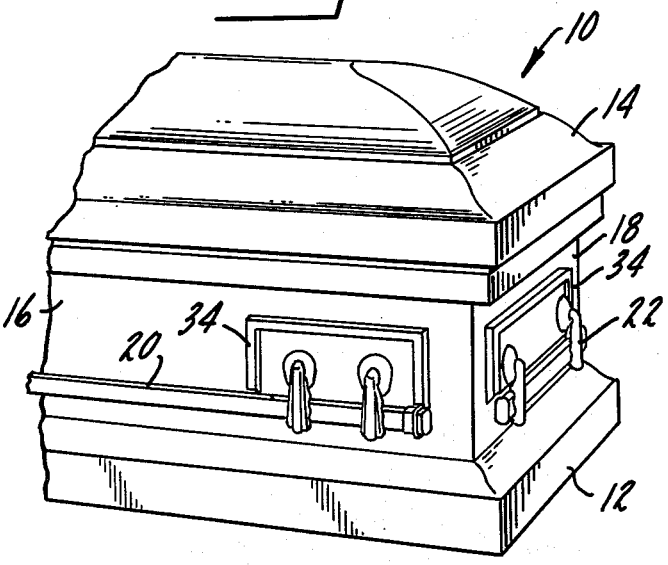
fig.2.
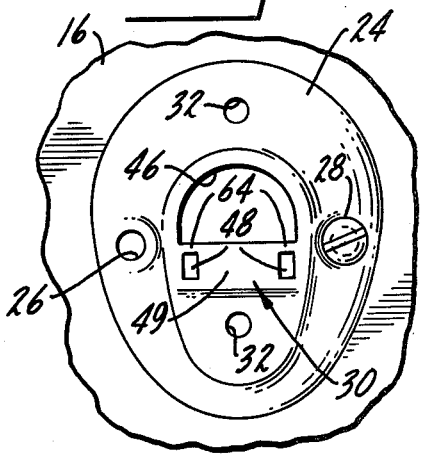
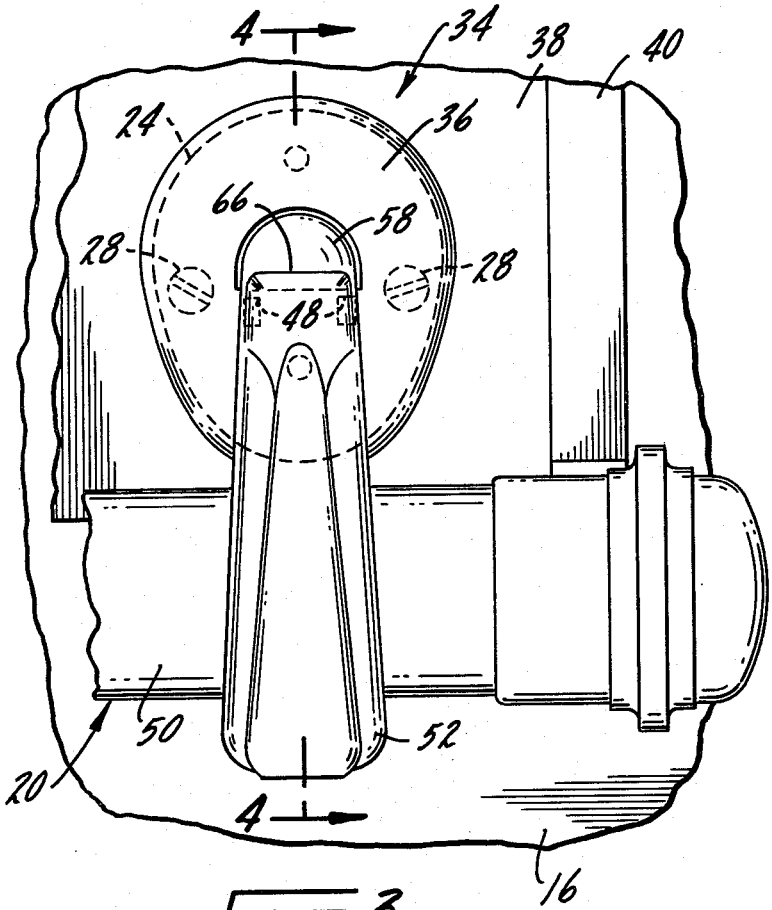
fig.3.
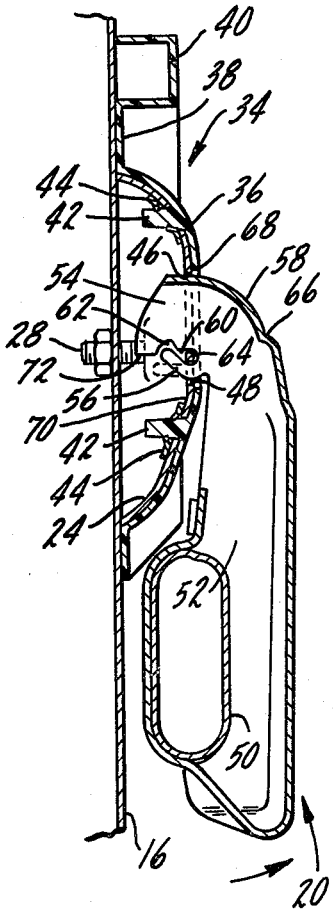
fig.4.

CASKET HANDLE STRUCTURE

SUMMARY OF THE INVENTION

This invention is concerned with a casket structure and more specifically is concerned with a handle mounting arrangement.

A primary object of the invention is a handle structure for a casket which provides a pleasant exterior appearance but at the same time combines strength and load-carrying capacity.

Another object is a casket structure with a handle arrangement which is accurate and sturdy in use but at the same time presents a pleasant exterior appearance.

Another object is a handle structure for a casket which involves a structural cup mounted on the outside of a casket, a decorative lug mounted over the cup and extending on all sides of it, and a handle socketed through the lug into the cup so that the decorative lug shields the cup from view, but at the same time does not interfere with or participate in the load-carrying function of the handle and cup.

Other objects will appear from time to time in the ensuing specification and drawings.

BRIEF DESCRIPTION OF THE DRAWINGS

FIG. 1 is a perspective view of a portion of a casket;

FIG. 2 is a plan view of a cup usable for mounting the handle shown in FIG. 1;

FIG. 3 is an enlarged plan view of a portion of the handle shown in FIG. 1; and FIG. 4 is a section along line 4—4 of FIG. 3.

DESCRIPTION OF THE PREFERRED EMBODIMENTS

In FIG. 1 a casket structure is indicated generally at 10 and includes the usual casket body 12 and lid or cover 14. The casket has a base or bottom, not shown, with outstanding walls, two of them being elongated side walls 16 and the other two being end walls 18. The casket may have a handle structure 20 on the side wall and a similar handle structure 22 on the end wall. The invention is concerned with either or both handle structures and may be considered hereafter to be a description of either.

An enlarged view of a portion of the handle structure is shown in FIG. 3 and includes a cup 24 in FIG. 2 which, as shown in FIGS. 2 and 4, is outwardly convex and may be considered to be a stamped steel part that is cupped or concaved inwardly and has openings 26, preferably two, for accepting bolts or screws 28 for mounting the steel cup on the side wall of the casket, as shown in FIG. 4. The center of the cup has a socket, indicated generally at 30, for accepting a part of the handle structure, as explained in detail hereinafter. At one or more suitable locations on the cup, holes or openings 32 may be provided for a purpose to be expained hereinafter.

After the cup 24 is mounted on the side wall of the casket by screws or bolts 28, a lug 34, which is in the nature of a panel, is mounting over it. The lug is somewhat enlarged and preferably is made of a decorative plastic. It may be an injection molded or vacuum-formed part and is shown as having an outwardly convex area 36 which corresponds quite closely to, if it doesn't exactly match, the exterior surface of the cup with peripheral areas 38 bounding the cup-matching portion 36 terminating on the outer edge thereof in a ridge or flange, channel or frame 40, or whatever decoration or boundary is considered desired or appropriate. One or more pins 42 project inwardly from the cup-matching convexity 36 and are aligned with the openings 32 in the cup so that when the lug is mounted over the cup, the pins may be forced through the openings 32. The inner surface of the cup has retainers 44 spot-welded or otherwise held thereon to engage the pins in a frictional fit in the nature of a fish hook nonreturn interlock, which is a well known retainer. While it has been stated that the retainers may be spot-welded or otherwise suitably held, such as by an adhesive, to the inner surface of the cup, it should be understood that the bolts 28 might be spot-welded or otherwise rigidly held in the cup through the holes 26 which would allow the lug 34 and retainers 44 to be previously assembled and then the bolts 28 inserted through suitable openings in the casket body with the nuts on the inside thereof, as shown in FIG. 4, being mounted afterwards.

As shown in FIG. 2, the handle socket 30 includes a half moon or half circle 46, or approximately so, with two rectangular openings 48 below each lower edge thereof, all on a flat surface 49. While not shown separately, the matching portion 36 of the lug may be considered to have the same opening arrangement so that a handle structure may be mounted therethrough as explained hereinafter.

The handle is shown in detail in FIGS. 3 and 4 and may be considered to be a part of either the side handle 20 or the end handle 22. The handle includes a bar 50 which is suitably connected to a leg 52 which may have a hollow or generally open interior and a decorative exterior, as shown in FIGS. 3 and 4. In cross section in its upper portion the leg is generally U-shaped and is curved inwardly, as shown in FIG. 4, with an upper somewhat enlarged portion 54 extending through the half circle opening 46 and lower legs or projections 56 on each side thereof extending into and through the rectangular openings 48. It will be noted that the upper surface of the upper portion 54 is somewhat curvilinear or arcuate, as indicated at 58, and is generally struck or described about a center which more or less coincides with the space 60 between the upper portion 54 and the legs 56.

For mounting the legs 56 extend more or less directly ahead in the dotted line position shown in FIG. 4. The upper portion 54 with the legs 56 may then be slipped into and through the openings 46 and 48, both in the lug and in the cup. Then from the inside, the legs 56 may be bent up or clinched into a recess 62 in the upper portion 54 so that they then surround or enclose the bridge portion 64 between the enlarged opening 46 and each of the smaller rectangular openings 48. With each of the legs 56 clinched up, as shown in the FIG. 4 arrangement, the upper portion of the handle will then in effect pivot about the bridge 64 with the curved exterior 58 pivoting inwardly until the handle is directed more or less out at 90° where an offset 66 in the handle will contact the outside of the lug. Additional lifting force applied to the handle will be taken between two contact points, the first being the offset 66 and the outside 68 of the lug-cup combination, and the second being between the inner surface 70 of the cup and abutting surfaces 72 on the handle inside of the pivot. Since the handle or leg 52 should be made of a structural metal, such as steel, and the cup is made of a similar metal, all of the lifting forces will be taken metal-to-metal and the decorative lug will not carry any of the load which, since is is probably plastic or a similar material, it is not designed or intended to do.

The result is that the cup may be made of a strong load-bearing metal which is not particularly attractive in appearance. But this doesn't matter since the cup will be completely covered by the lug. The lug, on the other hand, can be made from a decorative material, such as a plastic, and may have any suitable configuration and decorative exterior which, as is well known, plastic can be molded to. And this has the advantage that the lug does not carry any load so whether it is a metal or a plastic, it does not have to be thick or expensive. At the same time the lug completely covers or masks the structural parts of the mounting so that the overall combination gives a pleasant exterior appearance which, in the casket industry, is highly important. At the same time the arrangement is by no means expensive since the decorative portion, the lug, can be made of an inexpensive plastic and at the same time the structural portion, meaning the cup, can be made of a stamped metal.

Whereas it has been stated that the cup is connected to the side wall of the casket body by one or more screws, it should be understood that it may be welded or otherwise suitably connected thereto. Or in certain situations the cup might be stamped in the side of the casket body.

I have also stated that the lug has one or more projections that extend inwardly to mount the lug on the cup. It should be understood that this might be otherwise, for example a suitable adhesive might be used to adhere the lug to the cup or to the side wall of the casket body around the cup, or both.

I find it preferable that the lug and cup mate, as shown in FIG. 4, with a close conformity, but it should be understood that they may vary somewhat from each other and in reality a close conformity is not essential.

While the preferred form and several variations of the invention have been shown and described, it should be understood that suitable additional modifications, changes, substitutions and alterations may be made without departing from the invention's fundamental theme.

The embodiments of the invention in which an exclusive property or privilege is claimed are defined as follows:

1. In a casket structure, a casket body closed on the bottom and having four upstanding walls, two end walls and two side walls, and a handle structure attached to at least one of the walls, including an outwardly convex metal cup attached to the side wall with a handle-receiving socket therein, a decorative plastic lug mounted over the cup and overlapping it so as to prevent it from being seen and having at least one handle-receiving opening therein aligned with and exposing the cup socket, and a handle mounted on the casket body with an inwardly extending leg extending through the opening in the lug and pivotally mounted in the cup socket so that the loads applied to the handle will be passed through the lug without affecting it and will be transmitted directly to the cup.

2. The structure of claim 1 further characterized in that the cup is connected to the side wall of the casket body by one or more screws.

3. The structure of claim 1 further characterized by and including at least one inwardly extending projection on the lug, and an opening in the cup receiving the projection and thereby functioning as a mounting for the lug.

4. The structure of claim 1 further characterized in that at least a portion of the lug is outwardly convex and matches the exterior of the cup in dimension and shape so that when the lug is mounted thereon, it will closely conform to and will be in contact with the exterior of the cup throughout substantially its entire exterior surface.

5. The structure of claim 4 further characterized in that the lug overlaps the cup and extends for a substantial distance around it on four sides thereof so as to present a decorative exterior appearance.

* * * * *